United States Patent [19]

Garg et al.

[11] Patent Number: 4,465,587

[45] Date of Patent: Aug. 14, 1984

[54] PROCESS FOR THE HYDROLIQUEFACTION OF HEAVY HYDROCARBON OILS AND RESIDUA

[75] Inventors: Diwakar Garg, Macungie; Robert N. Miller, Allentown, both of Pa.

[73] Assignee: Air Products and Chemicals, Inc., Allentown, Pa.

[21] Appl. No.: 470,798

[22] Filed: Feb. 28, 1983

[51] Int. Cl.[3] ..... C10G 67/04

[52] U.S. Cl. ..... 208/87; 208/92; 208/112; 208/145

[58] Field of Search ..... 208/87, 96, 89, 92, 208/112, 145, 45, 311

[56] References Cited

U.S. PATENT DOCUMENTS

| | | | |
|---|---|---|---|
| 3,723,295 | 3/1973 | Kress | 208/96 |
| 3,781,196 | 12/1973 | Thompson | 208/96 |
| 3,969,196 | 7/1976 | Zosel | 203/49 |
| 4,021,335 | 5/1977 | Beaton | 203/309 |
| 4,111,787 | 9/1978 | Aldridge et al. | 208/10 |
| 4,115,246 | 9/1978 | Sweeney | 208/56 |
| 4,125,455 | 11/1978 | Herbstman | 208/108 |
| 4,191,639 | 3/1980 | Audeh et al. | 208/309 |
| 4,294,686 | 10/1981 | Fisher et al. | 208/56 |

FOREIGN PATENT DOCUMENTS 1576039 10/1980 United Kingdom .

OTHER PUBLICATIONS

Gulf Canada Ltd., Deutscher & Souhrada, "Gulf Canada Donor Refined Bitumen Heavy Oil Upgrading Process"-Aostra Conference, Jun. 10, 1982.

J. G. Speight & S. E. Moschopedis, Fuel Processing Technology, 2 (1979), 295-302, Netherlands.

*Primary Examiner*—Delbert E. Gantz

*Assistant Examiner*—Anthony McFarlane

*Attorney, Agent, or Firm*—Geoffrey L. Chase; E. Eugene Innis; James C. Simmons

[57] ABSTRACT

A process is set forth for the solvent extraction and hydroliquefaction of heavy hydrocarbon oils and residua having an API gravity at 60° F. of less than 20° in the presence of a hydrogen atmosphere and a hydrogen donor solvent at elevated temperature and pressure. Alternately, the hydrocarbon feed can be subjected to a vacuum distillation before solvent extraction or the liquefaction can be catalyzed in-situ. The process results in improved oil production and greater denitrogenation desulfurization and demetallization.

18 Claims, 2 Drawing Figures

PROCESS FOR THE HYDROLIQUEFACTION OF HEAVY HYDROCARBON OILS AND RESIDUA

TECHNICAL FIELD

The present invention is directed to the recovery of distillable oils from various heavy hydrocarbon oils and residua. More specifically, the invention is directed to the hydroliquefaction of such oils and residua in the presence of a hydrogen atmosphere and a hydrogen donor solvent.

BACKGROUND OF THE PRIOR ART

In the past, there has been little interest in the processing of heavy hydrocarbon oils and residua into useable liquid fuels. These heavy hydrocarbons include tar sand bitumen, oil sands and the residua left after higher quality petroleums have been distilled leaving a residue or as it is termed a residuum. In the recent past, various attempts have been made to upgrade these heavy hydrocarbon oils and residua in order to derive a new source for quality liquid fuels.

In U.S. Pat. No. 4,111,787, a process is set forth for the catalytic slurry hydroconversion of a heavy hydrocarbonaceous oil and coal mixture. The oil to be converted is admixed with an oil soluble metal compound which is converted to a catalyst in the presence of a hydrogen-containing atmosphere at elevated conditions. The reacted material is then mixed with coal in a subsequent hydroconversion zone for conversion of coal and oil to distillable oils. The use of a hydrogen donor solvent is specifically excluded.

U.S. Pat. No. 4,115,246 discloses a process for the upgrading of heavy liquid hydrocarbons in which a hydrogen donor diluent is mixed with the oil before being introduced into a cracker where the mixture is hydrocracked in the absence of hydrogen gas. The reaction product is fractionated and the residual pitch from the cracking reaction is partially oxidized to provide hydrogen for the rehydrogenation of depleted donor diluent to hydrogen donor diluent which is recycled to the front end of the process. The process is directed to the rehydrogenation of the donor solvent outside the cracking reactor.

U.S. Pat. No. 4,125,455 discloses a process for hydrotreating heavy residual oils with a catalyst comprising a Group 6B metal salt of a fatty acid. The heavy oil feedstock has a boiling point above 1,000° F. The feedstock is admixed with the catalyst and is reacted with hydrogen under hydroconversion conditions to produce a tar residue and a lower boiling oil product. Hydrogen donor solvent is specifically excluded.

In U.S. Pat. No. 4,294,686, a process is disclosed for the upgrading of heavy hydrocarbon oils in which the oil is first atmospherically and vacuum distilled before being mixed with a hydrogen donor solvent and reacted under hydrocracking conditions to produce a lighter oil product. Catalyst and hydrogen gas are not utilized in the hydrocracking reactor. As a matter of fact, the use of a catalyst is taught to be ineffective for improving the hydrocracking reaction. However, the hydrogen donor solvent is catalytically rehydrogenated outside the cracking reactor prior to recycle to the front end of the process.

All of the above prior art attempts at upgrading heavy hydrocarbon oils and residua have failed to produce an optimum distillable oil product with minimal gaseous products. The present invention as set forth below utilizes a unique combination of process steps and conditions in order to maximize the distillable oil product, while minimizing the gaseous products, as well as solid residue of the hydroliquefaction reaction. In addition, the process of the present invention achieves increased denitrogenation of the hydrocarbon material.

BRIEF SUMMARY OF THE INVENTION

The present invention is directed to a process for the hydrogen donor solvent hydroliquefaction of a heavy hydrocarbon oil or residuum having an API gravity at 60° F. of less than 20° comprising the steps of solvent extracting said oil or residuum with a non-hydrogen donor hydrocarbon solvent in order to remove at least some of the distillable oils from the oil or residuum prior to hydroliquefaction, mixing the solvent extracted residue oil or residuum with a hydrogen donor solvent having a boiling point of at least 375° F. to produce a liquefaction feedstock, hydroliquefying said feedstock in the presence of a hydrogen atmosphere at a pressure of at least 500 psia and a temperature of at least 650° F., separating the hydroliquefied product from any gas phase product which exists in the liquefied product, separating said hydroliquefied product into a distillable oil fraction and a non-distillable bottom fraction and recycling a portion of the distillable oil fraction to the mixing step as at least a portion of the hydrogen donor solvent.

Preferably the hydroliquefaction process is performed in the presence of a hydrogenation catalyst which consists of an unsupported, disposable metal or metal compound. Preferably, the metal compound is soluble in the hydrogen donor solvent.

Alternately, the hydroliquefaction process of the present invention can be performed on a heavy oil or residuum which is initially subjected to a mild vacuum distillation to remove lighter fractions of the feed material prior to the solvent extraction step.

Optionally, a portion of the non-distillable bottom fraction resulting from the hydroliquefaction step may be recycled to the mixing step for further hydroliquefaction treatment and to further utilize the catalytic activity of the spent catalyst.

Optionally, hydrogen can be recovered from the gas phase separated from the hydroliquefaction product and such hydrogen can be recycled to the hydroliquefaction step as at least a part of the hydrogen requirement needed for the hydrogen pressurized hydroliquefaction.

This process is preferably performed on a tar sand bitumen. Alternately, the process utilizes an oil sand bitumen as the inital feed hydrocarbon oil.

DETAILED DESCRIPTION OF THE INVENTION

Figure 1:
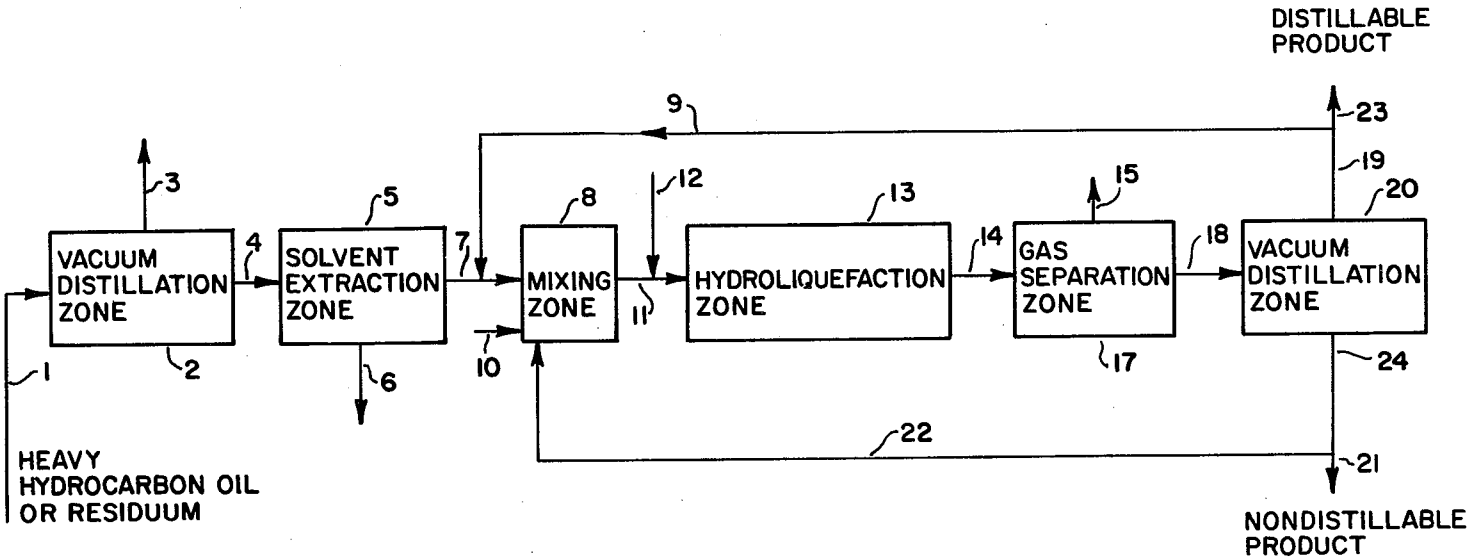
FIG. 1 is a schematic flowscheme of a preferred embodiment of the present invention.

The process of the present invention is directed to the upgrading of various heavy carbonaceous materials which usually have high metal contents as well as high nitrogen and sulfur content. These materials are generally unsuitable for traditional hydrocarbon refining operations. This process provides a method for recovering liquid fuel grade values from such carbonaceous materials at an unexpectedly high conversion rate, wherein the undesired gas production and the undesired residue formation are unexpectedly minimized. Normally when the conversion of a heavy hydrocarbon to a distillable oil product is increased, one would expect a higher resulting gas production as well. However, in the process of the present invention the oil conversion is shown to increase and the gas production is shown to decrease in comparison to the prior art, all accomplished with a reduction in the net residue material which must be subjected to combustion or utilization as a pitch type material.

The heavy hydrocarbon oils or residuums which can be processed in the present invention generally have an API gravity at 60° F. of less than 20°. This standard utilizes increasingly smaller numbers to indicate increasingly more viscous materials. Therefore this process is tailored to handling higher viscosity materials having an API gravity at 60° F. numerically less than or equal to 20°. Such materials include tar sand bitumen, oil sands, the residuum from traditional refining of lower viscosity hydrocarbons or petroleums, shale oils, coal derived fluids, and other heavy bituminous oils.

The heavy hydrocarbon oils or residua generally contain relatively large amounts of nitrogenous and sulfurous compounds as well as organo-metallic contaminents which are detrimental to known catalytic hydrorefining techniques. The organo-metallic contaminents generally contain nickel, iron and vanadium in combination with high molecular weight organic molecules. Because of these detrimental characteristics, it has been difficult to refine such feedstocks into utilizable products or fuels. Therefore, such materials have been left largely unutilized. Exemplary of such carbonaceous materials is the Athabasca tar sand bitumen which may contain 53.7 wt % of material boiling above 1032° F., 4.7 wt % sulfur, 0.6 wt % nitrogen, 300 ppm of vanadium, 100 ppm of nickel and 100 ppm of iron. The metal content of such feedstock may range up to 2000 ppm by weight or more and the sulfur content may range up to 8 wt % or more.

In order to minimize the amount of gaseous product which is produced during the hydrocarbon upgrading process of the present invention, it has been found that the removal of lighter hydrocarbons from the feedstock prior to hydroliquefaction decreases the gas make during such liquefaction. Although the inventors do not wish to be held to any specific theory, it is believed that by preliminarily removing lighter hydrocarbons before hydroliquefaction, these lighter hydrocarbons are not subject to the more rigorous hydrogenation conditions in the liquefier which would tend to produce small molecular weight hydrocarbons from the lighter hydrocarbons and thus form a gas phase. Such a gas phase is undesirable in that the most desired product in hydrorefining is a liquid fuel stock. Also, high hydrocarbon gas production results in high hydrogen consumption, which is uneconomical.

It has been found in the present process that the gas production or gas make can be significantly reduced when the feed material is first treated by at least a solvent extraction. The solvent extraction involves contact of the heavy hydrocarbon oil or residuum with a non-hydrogen donor solvent in order to remove lighter hydrocarbons which constitute solvent soluble components of the oil or residuum. The lighter hydrocarbons are removed with the solvent for separate recovery, while the residue heavy hydrocarbon oil or residuum is prepared for hydroliquefaction. Solvent extraction can be done by gas extraction, atmospheric liquid/liquid extraction, liquid extraction at mild elevated temperature (65° to 500° F.) and pressures, subcritical extraction, supercritical extraction and supercritical gas extraction.

Suitable gases and liquids which can be used as solvents include carbon dioxide, ammonia, methane, ethane, ethylene, propane, propylene, n-pentane, iso-pentane, butane, butylene $C_6$–$C_8$ hydrocarbons, nitromethane and mixtures thereof.

Solvent extraction can be performed as taught in U.S. Pat. Nos. 3,969,196; 4,021,335 and 4,191,639 all of which are hereby incorporated by reference. In performing the solvent extraction prior to hydroliquefaction a solvent is selected which will not extract asphaltenes (normally defined as materials insoluble in pentane, but soluble in benzene at room temperature), which require hydroliquefaction in order to be converted to useable liquid fuels. The extraction removes oils from asphaltenes and metals. Therefore, solvents for asphaltene, such as benzene, toluene, methanol and methylene chloride would not be used. The solvent extraction is particularly beneficial as a preliminary treatment of the heavy oil or residuum because it does not involve a severe heating step which can have the tendency to polymerize mid to higher range molecular weight hydrocarbons. Once the heavy hydrocarbon oil or residuum is subjected to a polymerizing level of heat, for instance 850° F. (corrected to 760 mm Hg) or above, an untreatable hydrogen deficient organic complex can be formed to some extent which is generally found as a residue or pitch in hydrorefining operations. Solvent extraction entirely avoids such a possibility. In this manner, the inclusion of a solvent extraction step in the hydroliquefaction of a heavy hydrocarbon oil or residuum offers a unique opportunity to reduce the gas make and the pitch formation in a hydrorefining technique.

Traditionally, hydrorefining techniques can include distillations to remove volatile hydrocarbons without more rigorous hydrorefining, such as hydrogenation and hydrocracking. However, deep distillation treatments can polymerize some of the hydrocarbons to an unrefinable degree to produce pitch which constitutes an undesired by-product of a hydrorefining technique. The present invention avoids such deep distillations which are generally conducted at fairly high temperatures, such as above 850° F. (corrected to 760 mm Hg). However, it has been found to be beneficial in the present invention to utilize a mild vacuum distillation at a temperature below 850° F. (corrected to 760 mm Hg) in order to preliminarily remove highly volatile portions of the heavy hydrocarbon oil or residuum feedstock prior to the more rigorous hydroliquefaction reaction. Again, this has the effect of removing these lighter hydrocarbons so that they are not subject to rigorous hydrogenation or cracking wherein they may form an undesired gas phase. By maintaining vacuum conditions during distillation and avoiding excessive temperatures, such as above 850° F. (corrected to 760 mm Hg) this form of distillation avoids the detriment of polymerization of hydrocarbon components with the resulting formation of the undesired by-product pitch. The unique combination of a mild vacuum distillation and a solvent extraction with a non-hydrogen donor solvent contributes to the unexpected results of the present invention process, wherein extremely low gas make and pitch formation are experienced.

After the mild vacuum distillation and the non-hydrogen donor solvent extraction of the heavy hydrocarbon oil or residuum, the residue of the solvent extraction, containing the predominent amount of the heavy hydrocarbon oil or residuum and metals, is then mixed with a hydrogen donor solvent in preparation for the hydroliquefaction reaction. The hydrogen donor solvent differs from the solvent of the solvent extraction stage in that it is generally a much higher molecular weight hydrocarbon material and characteristically has cyclic and aromatic attributes. However, the most important attribute that the hydrogen donor solvent has is its ability to donate hydrogen to the residue oil or residuum during the high temperature liquefaction reaction. The hydrogen donor solvent also must have the attribute of being able to be rehydrogenated in order to act as a cyclic vehicle for the collection of hydrogen and the donation of hydrogen to the free radicals formed from the oil or residuum which are created by the high temperature and the high pressure reaction conditions in the hydroliquefaction step. The available hydrogen from the hydrogen donor solvent reacts with the free radicals generated by thermal treatment of the feedstocks, and therefore prevents the repolymerization of the free radical into high molecular weight materials and super high molecular weight materials, such as pitch and coke. A typical cyclic hydrogen donor solvent is the tetralinnaphthalene solvent pair. The hydrogenated solvent exists as tetralin, whereas the hydrogen depleted solvent after hydrogen donation is in the form of naphthalene. The hydrogen donor solvent employed will consist of an intermediate stream or fraction, which is defined as one boiling between 375° F. and 800° F. derived from the hydroliquefaction process. This stream comprises hydrogenated aromatics, naphthenic hydrocarbons, phenolic materials and similar components and will normally contain at least 30 wt %, preferably at least 50 wt % of compounds which are known to be hydrogen donor under the temperature and pressure conditions employed in the hydroliquefaction reaction. Suitable aromatic hydrogen donor solvents include creosote oil, hydrogenated creosote oil and other intermediate product streams from catalytic cracking of petroleum feedstocks, and coal-derived liquids which are rich in indane, $C_{10}$ and $C_{12}$ tetralin, decalins, biphenyl, methylnaphthalene, dimethylnaphthalene, $C_{12}$ and $C_{13}$ acenaphthenes and tetrahydroacenaphthenes and similar donor compounds. Generally the solvent should make up from 10 to 90% of the total liquefaction feedstock, but preferably it would constitute 50% of the feedstock.

The liquefaction feedstock comprising the hydrogen donor solvent and the solvent extracted residue of the oil or residuum is introduced into the hydroliquefaction reactor where it is subjected to high temperature and pressure in the presence of a hydrogen atmosphere. Preferably the temperature would be above 650° F. Optimally, the temperature would be approximately 800° F. The high temperature sustains the breaking of the high molecular weight components of the residue oil or residuum into smaller molecular weight components which have free radicals at the point of the rupture of the molecule. Hydrogen from the hydrogen donor solvent is effective in reacting with the free radical to saturate the radical so that it will no longer react with other free radicals in the reaction zone. This process effectively caps the end of the broken high molecular weight component so that a lower molecular weight component will be sustained and will not have the opportunity to repolymerize to its original size or, much worse, to a highly polymerized state which is incapable of hydrorefining, such as is exemplary with the pitch residues of most hydrorefining reactions. A high pressure is also necessary in the hydroliquefaction reactor in order to provide sufficient hydrogen and reaction conditions for the hydrogenation of the free radicals and the rehydrogenation of the depleted donor solvent. Preferably the pressure of the hydroliquefaction stage is between 500 and 5000 psia. Optimally, the pressure would be approximately 2000 psia. A unique aspect of the hydroliquefaction stage of the present invention is the use of hydrogen in the hydroliquefaction stage in combination with the hydrogen donor solvent. The presence of hydrogen in the reactor effects an improved yield of distillable oil product from the hydroliquefaction. Although the inventors do not wish to be bound to any particular theory, it is believed that the combination of hydrogen and a hydrogen donor solvent in the hydroliquefaction stage is beneficial because the hydrogen allows the in-situ rehydrogenation of the depleted hydrogen donor solvent in the reaction zone. Hydrogen donor solvent becomes inactive after it is depleted of its available hydrogen. It then requires rehydrogenation. Prior art processes which rehydrogenate the solvent outside the reactor necessarily require that a certain minimum amount of depleted hydrogen donor solvent exists in the hydroliquefaction reaction zone. However, the combination of a hydrogen atmosphere at high pressure along with the hydrogen donor solvent in the hydroliquefaction stage of the present invention allows for continued and rapid rehydrogenation of the depleted hydrogen donor solvent such that the level and rate of hydrogenation of hydrocarbon free radicals from the hydrogen donor solvent is not hampered but is optimized. It is believed that this unique interaction of the hydrogen with the hydrogen donor solvent provides at least a portion of the improvement in process results experienced by the present invention. The hydrogen flow rate in the hydroliquefaction reaction zone should be in a quantity of up to 50,000 SCF per barrel of feed. Optimally, the hydrogen flow rate in the reaction zone should be approximately 20,000 SCF per barrel of feed. Again, although the inventors do not wish to be held to any specific theory, it is believed that the hydrogen does not directly hydrogenate free radicals formed during the liquefaction reaction. It is felt that the hydrogen can only act through the hydrogen donor solvent to interact with the free radicals. Therefore, it is necessary that the hydrogen donor solvent exist in conjunction with the hydrogen in the reaction zone in order to effect the beneficial conversion and avoidance of polymerization of the hydrocarbon feedstock.

In order to improve the in-situ rehydrogenation of the hydrogen donor solvent in the hydroliquefaction reaction zone, it is contemplated by the process of the present invention to include a catalyst in the liquefaction feedstock introduced into the hydroliquefying stage. The catalyst would be a hydrogenation catalyst preferably an unsupported catalyst which is disposable. Generally unsupported catalysts are less expensive than supported catalysts and the expense of the catalyst is a major attribute in determining whether the catalyst will be deemed disposable within the context of the process economics of the hydroliquefaction reaction. The hydrogenation catalyst is believed to interact in the stage of the hydroliquefaction reaction where hydrogen is being introduced into the solvent, that is the rehydrogenation of the depleted hydrogen donor solvent. It is not felt that the catalyst directly influences the cracking of the high molecular weight components of the feedstock or the transfer of hydrogen from the hydrogen donor solvent to the free radicals of the cracked components of the feedstock. In effect, the improvement which is achieved by the addition of catalyst to the liquefaction feedstock to the hydroliquefaction zone comes in the form of increasing the in-situ rehydrogenation of the hydrogen donor solvent so that a high ratio of hydrogenated solvent to depleted solvent exists in the reaction zone. Of course the presence of a predominance of rehydrogenated hydrogen donor solvent improves the reaction conditions and the resulting product of the liquefaction.

Although finely divided solid catalyst can be utilized to form a slurry feedstock to the hydroliquefaction zone, it is preferred to introduce an oil soluble metal compound as the hydrogenation catalyst for the hydroliquefaction reaction. Preferably the metal catalyst is selected from Groups IVB, VB, VIB, VIIB and VIII of the Periodic Table of the Elements. Mixtures of such metals and metal compounds can also be used. The catalyst is used in a range of about 10 to less than 10,000 weight part per million of the metal or metal compound calculated on the basis of the elemental metal existing in the compound in comparison to the initial charge of heavy oil or residuum. Suitable oil soluble metal compounds include inorganic metallic halides, oxyhalides, and heteropolyacids, such as phosphomolybdic acid, and molybdosilicic acid; metal salts of organic acids such as acyclic, alicyclic aliphatic carboxylic acids containing two or more carbon atoms, such as naphthenic acids; aromatic carboxylic acids, such as toluic acid; sulfonic acid, such as toluenesulfonic acid; sulfinic acid, mercaptans, xanthic acid, phenols, di- and polyhydroxy aromatic compounds; organo metallic compounds, such as metal chelates such as 1,3-diketones, ethylenediamine, ethylenediamine tetraacetic acid and phthalocyamines, as well as metal salts of organic amines, such as aliphatic amines, aromatic amines and quaternary ammonium compounds. The specific preferred catalyst is molybdenum octoate. Alternately, other preferred specific catalysts include molybdenum and iron compounds.

The liquefaction feedstock preferably contains a concentration of the heavy hydrocarbon oil or residuum of between 10 to 90 wt %, typically between 35 to 75 wt %. Optimally, the concentration is 50 wt %. It is important to avoid excessively low viscosities and excessively high viscosities in order to remain economical and to avoid handling problems respectively. Superficial flow rates of the liquefaction feedstock through the hydroliquefaction reactor are chosen to maintain good agitation in the reactor which insures good mixing. The superficial gas rates will be from 0.05 to 3 ft./sec. and the superficial liquid velocity will generally be between 0.003 to 0.1 ft./sec. Specific flows are chosen such that the feed with its incipient catalyst particles moves through the reactor with minimal accumulation. The nominal residence time will be from 0.2 to 10 hours. Optimally, the nominal residence time is 60 minutes.

After the hydroliquefaction stage, the reactor contents are passed to a high pressure separating zone where the effluent is flashed at a temperature from 150° F. to within about 50° F. of the reactor outlet temperature, which is between 650° and 900° F. The overhead stream which comprises the gas phase includes light gases, such as hydrogen, hydrogen sulfide, carbon monoxide, carbon dioxide, ammonia, water and the $C_1$–$C_5$ light hydrocarbon gases. After initial separation, the acidic and alkaline components of the gas phase are removed and the resulting hydrogen-rich stream can be recycled to the hydroliquefaction stage as at least a portion of the hydrogen atmosphere necessary in the hydroliquefaction reactor.

The liquid bottom stream from the phase separation following the hydroliquefaction step is subjected to distillation in a vacuum distillation tower in order to recover the distillable oil product which is the desired end product of the entire process. The bottoms from this vacuum distillation step are removed as a pitch material which can be partially oxidized to a reducing gas or the pitch may be at least partially recycled to the front end of the hydroliquefaction zone in order to be incorporated in the liquefaction feedstock comprising the heavy hydrocarbon oil or residuum and the hydrogen donor solvent. A portion of the distillable liquid oil product may be recycled to form at least a portion of the hydrogen donor solvent. Optionally, the liquid bottom stream is treated in a centrifuge or cyclone separator to recover spent catalyst, which is recycled to the front end of the hydroliquefaction zone to further utilize its catalytic activity. The centrifuged or cyclone separated liquid is then distilled to recover distillable and non-distillable products. The process will be explained in greater detail by reference to the accompanying drawing.

With reference to FIG. 1, the preferred process will be described. As will be readily apparent from a review of FIG. 1, the process is shown with a vacuum distillation stage 2. This is considered an optional portion of the process of the present invention, although it also constitutes a preferred embodiment of the invention. The process is deemed operational with the exclusion of such zone and the immediate processing of the feed material in a solvent extraction zone. For the present purposes the preferred embodiment incorporating vacuum distillation will be set forth.

A heavy hydrocarbon oil or residuum having an API gravity at 60° F. of 20° or less such as a tar sand bitumen is introduced in line 1 into a vacuum distillation zone 2. The vacuum distillation zone can constitute a distillation tower wherein light distillate oil product is removed from the overhead of the column in line 3 while the heavier liquid hydrocarbon oil or residuum is removed as a bottom fraction in line 4. The distillation is conducted at a mild temperature below 850° F. (corrected to 760 mm Hg) and vacuum conditions in order to avoid the polymerization or pitch formation which may occur under higher temperature conditions. The operation under vacuum allows for the reduction of distillation temperatures.

The distillation bottom stream in line 4 is then introduced into a solvent extraction zone 5. The bottom fraction is subjected to extraction with a solvent such as $C_1$ to $C_8$ hydrocarbons, which removes soluble oil products that were not volatilized in the vacuum distillation. The solvent is recovered from the soluble oils by distillation and is recycled back to the solvent extraction zone 5. The solvent distillation and recycle is not shown in the figures. The solvent soluble oils are removed through line 6. Both the oil in line 3 and the oil in line 6 is amenable to processing as a lighter refinery feed, and it is not necessary to subject it to the more rigorous conditions of the hydroliquefaction reaction.

The solvent extraction residue which constitutes heavy hydrocarbon oil or residuum which is not volatilized by distillation or extracted by the solvent is removed in line 7 and is mixed with a hydrogen donor solvent in line 9. In FIG. 1, the solvent is shown being recycled from the downstream product of the process. However, it can be contemplated that the solvent may be freshly administered to the residue or constitute any reasonable combination of fresh hydrogen donor solvent and recycle hydrogen donor solvent. The residue and hydrogen donor solvent as a liquefaction feedstock are mixed in the mixing zone 8 optionally with a hydrogenation catalyst in line 10 and optionally with spent catalyst and a bottoms fraction from the downstream product of the process in line 22. This feedstock is then introduced into the hydroliquefaction zone 13 through line 11. Hydrogen is introduced into the feedstock in line 12 immediately prior to the liquefaction zone. However, it is contemplated that hydrogen could be added directly to the hydroliquefaction zone. Also, it is contemplated that the hydrogen may be introduced as a separate stream or as a recycle stream from the downstream gas separation zone below the hydroliquefaction zone. Alternately, the hydrogen can be produced from the partial oxidation of unconverted bitumen from the downstream product area of the process.

In the hydroliquefaction zone 13 the feedstock in the presence of hydrogen donor solvent and the hydrogen atmosphere is hydrogenated to produce predominently lower molecular weight hydrocarbons in the form of distillable oils. Preferably, this process is a catalytic hydroliquefaction reaction. Alternately, at least a portion of the catalyst can be spent catalyst recycled from the downstream portion of the process along with a bottom fraction from the final distillation zone. The hydroliquefied product is removed in line 14.

The hydroliquefied product is separated from a gaseous phase which is removed in line 15 from the gas separation zone 17. Again, the gaseous phase may be cleaned up and separated into a hydrogen rich recycle stream which may be introduced into line 12. The liquid portion of the hydroliquefied product is removed as liquid product in line 18.

The liquid product is then subjected to distillation in a vacuum distillation zone 20 wherein a distillable oil fraction is removed in line 19 to be recovered as product at 23. Preferably, at least a portion of the hydrogen donor solvent for the process is produced by recycling a portion of the distillable oil product in 19 by means of line 9. The unconverted material such as tar sand bitumen and pitch, as well as spent catalyst is removed as a bottom stream in line 24. A portion of this spent catalyst and bottoms material can be recycled to the front end of the hydroliquefaction zone in line 22. The remainder of the unconverted bitumen bottoms and spent catalyst is removed as a fuel stock in line 21. This material may be sent to a gasifier to produce hydrogen for the hydrogen necessary in line 12 or for the production of steam for plant power and heat.

In addition to affecting an improved recovery of distillable oils and overall product conversion rate, it has been noted that the process of the present invention also provides improved denitrogenation and desulfurization of the feedstocks. The feedstocks constitute heavy hydrocarbon oils and residua which have been known to have undesirably high levels of nitrogen and sulfur component contamination. These attributes make refining of such materials undesirable and uneconomical. However, the process of the present invention effects a favorable reduction in the nitrogen and sulfur contents of the distillable products of the process. This favorable denitrogenation and desulfurization has also been shown to occur wherein the hydroliquefaction is conducted with only a preliminary distillation treatment and not with the solvent extraction step. In addition, the favorable denitrogenation and desulfurization has also been shown to occur to a favorable degree with the hydroliquefaction of the present process without any preliminary treatment whether it be a distillation or a solvent extraction. It is believed that this attribute as experienced in portions of the overall process, and specifically the hydroliquefaction stage, exemplifies the fact that the hydroliquefaction with hydrogen donor solvent and a hydrogen atmosphere in-situ in the liquefaction reaction zone provide exceptional benefits for the production, not only of liquid product, but liquid product having desired attributes, namely reduced nitrogen, sulfur and metal levels.

The following set of examples illustrate the process of the present invention in greater detail.

EXAMPLE 1

This example illustrates the products obtained by vacuum distillation of full range Athabasca bitumen in zone 2 of the process flow diagram in FIG. 1. The feed to distillation was comprised of full range Athabasca bitumen with composition of C=83.1%, H=10.6%, N=0.6%, O=0.7%, S=4.8% and 13.2% Conradson carbon. Twenty gallons of bitumen were cut by vacuum flash distillation using a 120-gallon batch still equipped with a 4" diameter 15 plate column, 15 feet high. The overhead yield (line 3 in FIG. 1) which represents a nominal initial boiling point to 850° F.-cut was 24.3% of the full range feed. The final boiling point was corrected to 760 mm Hg. The distillation bottoms (line 4) represented 75.7% of the feed.

EXAMPLE 2

This example illustrates the extraction (zone 5) of the vacuum distillation bottoms from zone 2 in FIG. 1 using n-pentane solvent. Vacuum distillation bottoms from Example 1 were placed in a 5-gallon Pfaudler steel extraction kettle and extracted with n-pentane for 90 minutes using a 360 rpm stirrer speed. The yield of pentane soluble oil (line 6) was determined to be 72% of the vacuum still bottoms or 54.5% of the full range bitumen. The residue from the solvent extraction to line 7 in FIG. 1 represented only 21.2% of the full range feed.

EXAMPLE 3

The following examples provide data to illustrate the hydroliquefaction zone of the proposed invention. The data is represented in Table 1 and is by percent of the bitumen residue fed to the hydroliquefier.

EXAMPLE 3A

This example illustrates the hydroliquefaction of the bitumen residue (from line 7) without any added catalyst. The feed was that of a hydrogen-donor solvent (tetralin) and the n-pentane extracted vacuum still bottoms of Example 2. The bitumen residue-tetralin mixture (5 grams bitumen and 5 grams tetralin) was reacted in a 50 ml tubing-bomb reactor at a cold hydrogen pressure of 800 psig. A reaction temperature of 425° C. and a residence time of 40 minutes were used. The reaction product distribution obtained was as shown in Table 1. The yields of oils and gases were 50.1% and 3.8% of the bitumen residue respectively and the hydrogen consumption was estimated at 0.2 wt %. Significant denitrogenation (30%) was also noted. Nitrogen in the oil from hydroliquefaction was less than 0.05 wt %, making it premium quality feedstock for further traditional refining.

EXAMPLE 3B

This example illustrates the hydroliquefaction of the bitumen residue of zone 7 in the presence of conventional supported catalysts (sulfide Co/Mo and Ni/Mo supported on alumina). These supported catalysts were used for comparison. The bitumen-tetralin-catalyst mixture (5 g bitumen, 5 g tetralin and 50 mg catalyst) was reacted in a tubing-bomb reactor at the same reaction conditions described in Example 3A. The reaction product distribution obtained was as shown in Table 1. The conversion of bitumen residue to oils increased by about 7% absolute over the no catalyst run in Example 3A. The hydrogen donor quality of generated solvent was higher than Example 3A as determined by the tetralin/naphthalene ratio.

EXAMPLE 3C

This example illustrates the reaction of the bitumen residue (line 7) in the presence of solid nonsupported Zn-Mo oxide as catalyst. The feed mixture and reaction conditions were the same as described in Example 3A. The experimental results, shown in Table 1, indicated slightly higher conversion of bitumen residue to oil as compared to the standard supported catalysts in Example 3B.

EXAMPLE 3D

This example illustrates the reaction of bitumen residue in the presence of a liquid-phase molybdenum octoate catalyst containing 8 wt % molybdenum as free metal. The bitumen-tetralin-catalyst mixture (5 g bitumen, 5 g tetralin and 0.04 or 0.08 wt % free molybdenum metal based on bitumen feed) was reacted in a tubing-bomb reactor at the same reaction conditions described in Example 3A. The reaction product distribution obtained was as shown in Table 1. Conversion of bitumen residue to oils and gases, denitrogenation, desulfurization and hydrogen-donor quality of generated solvent were significantly higher than shown in Examples 3A, 3B or 3C. The conversion of bitumen also increased slightly with increasing catalyst concentration.

EXAMPLE 3E

This example illustrates the reaction of bitumen residue in the presence of molybdenum octoate catalyst in a 300 ml reactor. The feed consisted of 50 g bitumen residue and 50 g tetralin. The feed mixture was mixed with 800 ppm of free molybdenum metal based on bitumen residue in the form of molybdenum octoate. The reaction mixture was reacted at 797° F., 2000 psig hydrogen pressure for 40 minutes. The reaction conditions were essentially the same as described in Example 3A. The product distribution obtained given in Table 1 is essentially the same as obtained in a tubing-bomb reactor (Example 3D).

TABLE 1

| | Hydroliquefaction of Bitumen Residue (from line 7) | | | | | | |
|---|---|---|---|---|---|---|---|
| | Example 3A | Example 3B Alumina Supported | | Example 3C Zn/Mo | Example 3D Mo-Octoate | | Example 3E Mo-Octoate |
| Catalyst | None | Ni—Mo | Co—Mo | Oxide | 400 ppm | 800 ppm | 800 ppm |
| Product Distribution, wt % Bitumen | | | | | | | |
| $CH_4$ | 0.65 | 0.65 | 0.70 | 0.95 | 0.60 | 0.78 | 0.65 |
| $C_2$–$C_4$ | 0.92 | 0.96 | 1.01 | 1.21 | 0.78 | 0.87 | 0.53 |
| $CO_x$ | 0.13 | 0.15 | 0.19 | 0.21 | 0.21 | 0.29 | 0.25 |
| $H_2S$[2] | 2.11 | 2.79 | 2.35 | 2.46 | 2.35 | 2.97 | 3.34 |
| Oils[1] | 50.10 | 56.70 | 58.20 | 59.90 | 61.40 | 63.90 | 64.10 |
| Residue | 46.09 | 38.75 | 37.55 | 35.27 | 34.66 | 31.19 | 31.10 |
| Conversion, wt % Bitumen | 53.91 | 61.25 | 62.45 | 64.73 | 65.34 | 68.71 | 68.90 |
| Tetralin/Naphthaline Ratio | 5.6 | 12.5 | 11.0 | — | — | 18.8 | — |
| Overall Denitrogenation % | 30.0 | — | — | — | — | 57.0 | — |
| Over Desulfurization % | 24.0 | — | — | — | — | 36.0 | — |

[1]Determined by Pentane Extraction
[2]Determined by Elemental Sulfur Balance

The examples illustrate the overall yield which can be obtained in the process of the present invention (wt % of full-range bitumen) for the various process steps described in FIG. 1. The product distribution obtained from the overall process is shown in Table 2. The oil yields of 89.4 (uncatalyzed) and 92.5 (catalyzed) reported in Table 2 represent the sums of the vacuum distillate (24.3%), the n-pentane extract (54.5%) and the hydroliquefaction oils (10.6% from the run in Example 3A with no catalyst) (13.6% from the run in Example 3E with the soluble Mo catalyst). Note that the overall gas make is approximately 1.0 wt % based on the full-range bitumen feed. The overall conversion of bitumen to oils and gases is 90.2% and 93.4%, respectively.

The residue from the hydroliquefaction stage (at zone 21) represents only 6.6% of the full range feed in the catalytic hydroliquefaction run with a composition as given in Example 1. The relatively high hydrogen content of the hydroliquefaction bottoms (atomic H/C=0.92) demonstrates that the residue material is a pitch-like solid as opposed to coke or char. Furthermore, petrographic examination of the residue material indicated no anisotropic coke formation.

The results of Example 3A–3E which are directed to the hydroliquefaction stage of the process of the present invention are set forth in Table 1. It is important to note that the oil production rate must be added to the oil makes from the distillation and solvent extraction stages in order to come up with the overall oil make of the process in total. Table 2 shows the optimum oil make for Example 3E using a catalyst of molybdenum octoate as well as the 3A uncatalyzed oil make. The oil make is the sum of the overall process including vacuum distillation overhead, the pentane extract of the distillation bottoms and the oils produced during hydroliquefaction.

TABLE 2

| Overall Product Distribution (wt % Full-Range Bitumen) | | |
|---|---|---|
| | Hydroliquefaction Reaction | |
| | No-Catalyst | Mo-Octoate |
| Gases | 0.8 | 0.9 |
| Oil | 89.4 | 92.5 |
| Unconverted Material | 9.8 | 6.6 |
| Overall Conversion | 90.2 | 93.4 |

The total oil make and conversion of all of the Example 3 runs coupled with Examples 1 and 2 are given in Table 3 which shows that the average of all the runs of the FIG. 1 process of the present invention in conjunction with a distillation and solvent extraction preliminary step results in a 91.34% oil make based upon feedstock.

TABLE 3

| | Oil Make |
|---|---|
| Example 3A | 89.4% |
| Example 3B First Run | 90.8% |
| Example 3B Second Run | 91.1% |
| Example 3C | 91.5% |
| Example 3D First Run | 91.8% |
| Example 3D Second Run | 92.3% |
| Example 3E | 92.5% |
| Average | 91.34% |

As can be seen from Table 3, the process of the present invention provides exceedingly high oil conversion rates for the hydroliquefaction of heavy hydrocarbon oils and residua.

Figure 2:
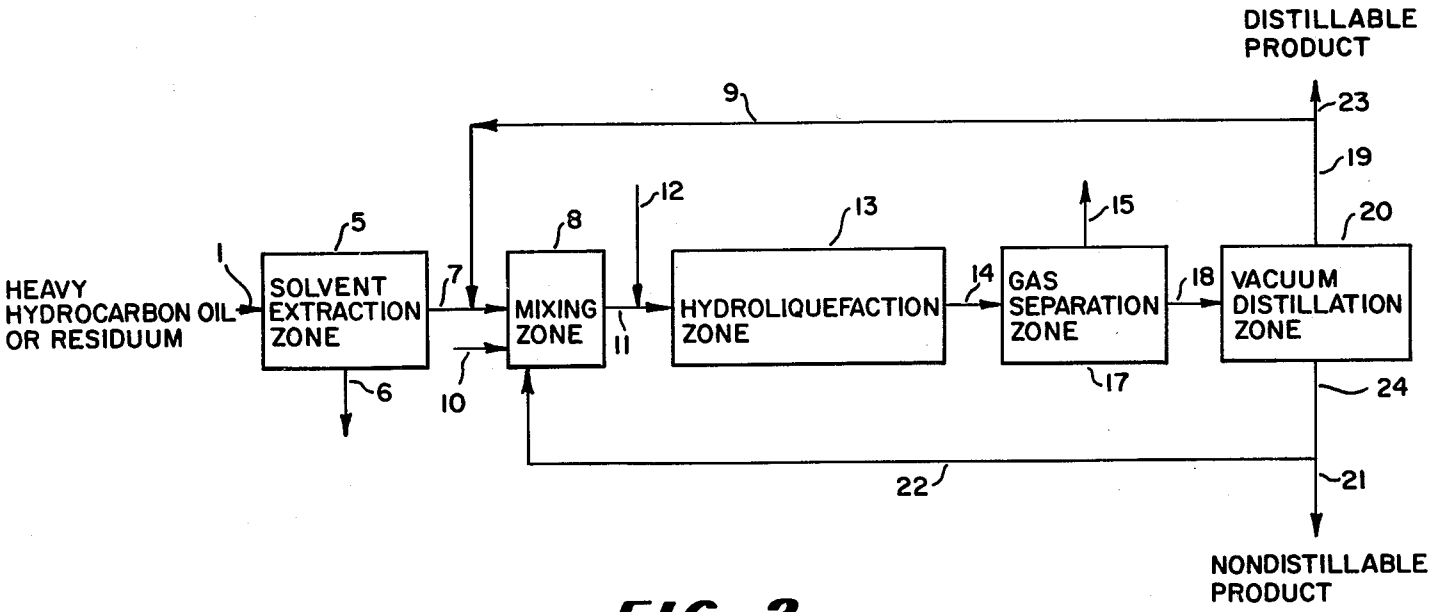
FIG. 2 is a schematic flowscheme of another preferred embodiment of the present invention.

The following examples demonstrate the present invention when the feedstock has not been preliminarily subjected to a vacuum distillation (FIG. 2).

EXAMPLE 5

This example illustrates the solvent extraction of full range Athabasca bitumen in zone 5 of the process flow diagram in FIG. 2 using n-pentane solvent but without the distillation in zone 2 of FIG. 1. A 200 gram feed of bitumen was mixed with 2 liters of n-pentane in a beaker. The pentane soluble material was filtered to separate the solid pentane insoluble material from it. The insoluble filter residue was washed with additional pentane to recover any trace of pentane solubles from the filter cake residue. The combined filtrate was roto evaporated to remove pentane solvent from pentane solubles in order to recover oil. The filter cake was dried in the presence of nitrogen at room temperature to recover the pentane extracted residue. The yield of pentane soluble oil (line 6) was determined to be 84% of the full range bitumen feed. The residue from the solvent extraction to line 7 in FIG. 2 represented only 16% of the full range feed. The composition of the pentane extract (solubles) residue (insolubles) and full range bitumen is given in Table 4. Notice the low nitrogen and ash contents of the extracted oils which makes it a good feedstock for further upgrading.

EXAMPLE 6

The following examples provide data to illustrate the hydroliquefaction zone of the proposed process shown in FIG. 2 wherein a feed is utilized which has not been preliminarily distilled.

EXAMPLE 6A

This example illustrates the hydroliquefaction of the bitumen residue without any added catalyst. The feed consisted of 6 g hydrogen-donor solvent (tetralin) and 6 g n-pentane extracted residue of Example 5. The feed was reacted in a 50 ml tubing-bomb reactor at a cold hydrogen pressure of 850 psig. Reaction temperature of 797° F. and a residence time of 60 minutes were used. Reaction product distribution obtained was as shown in Table 5. The yield of oils was 57.2% of the bitumen residue. The oils yield was considerably higher than that noted in Example 3A. This is probably due to polymerization of part of the full range bitumen feed during distillation (Example 1). Since solvent extracted full range bitumen (Example 5) is not subjected to high temperatures, 850° F. (corrected to 760 mm Hg), it is more responsive to hydroliquefaction. Ash balance, summarized in Table 6, showed that a part of the metal present in the feed bitumen residue ended up in the oils fraction.

EXAMPLE 6B

This example illustrates the reaction of bitumen residue in the presence of molybdenum octoate catalyst in a tubing-bomb reactor. The bitumen-tetralin mixture described in Example 6A was mixed in two runs with 500 and 1000 ppm of free molybdenum metal based on bitumen residue in the form of molybdenum octoate and reacted at the same reaction conditions described in Example 6A. The reaction product distribution obtained was as shown in Table 5. Conversion of bitumen residue to oils and gases was significantly higher than shown in Example 6A. The conversion of bitumen also increased slightly with increasing catalyst concentration. Overall desulfurization as evidenced by $H_2S$ gas production and overall sulfur balance increased with catalyst compared to the no catalyst run (Example 6A). Overall denitrogenation also increased with catalyst. The ash content in the oils (Table 6) was nearly zero which indicated that catalyst was also active in demetallizing the products.

TABLE 4

| Products Composition Data | | | |
|---|---|---|---|
| | Full Range Bitumen | Pentane Solubles | Pentane Insolubles |
| C | 83.1 | 84.2 | 79.6 |
| H | 10.6 | 11.7 | 8.0 |
| N | 0.6 | 0.2 | 2.4 |
| O | 0.7 | 0.5 | 1.2 |
| S | 4.8 | 4.5 | 9.2 |
| Ash | 0.46 | 0.12* | 2.3 |

*Calculated by difference

TABLE 5

| Hydroliquefaction of Bitumen Residue (line 7 of FIG. 2) in 50 ml Tubing-Bomb Reactor | | | |
|---|---|---|---|
| | Example 6A | Example 6B Mo-Octoate | |
| Catalyst | None | 500 ppm | 1000 ppm |
| Product Distribution, wt % Bitumen | | | |
| $C_1$–$C_5$ | 1.9 | 2.0 | 1.8 |
| $CO_x$ | 0.2 | 0.2 | 0.2 |
| $H_2S$[1] | 3.39 | 4.1 | 4.2 |
| Oils[2] | 57.2 | 62.8 | 64.6 |
| Residue | 36.5 | 30.9 | 29.2 |
| Conversion, wt % Bitumen | 63.5 | 69.1 | 70.8 |
| Overall Desulfurization, % | 36.8 | 44.2 | — |
| Overall Denitrogenation, % | 5.4 | 13.7 | — |

[1]Determined by Sulfur Balance
[2]Determined by Pentane Extraction

TABLE 6

| Ash Balance in Bitumen Residue Hydroliquefaction | | |
|---|---|---|
| | Wt. % of Ash in Feed Bitumen Residue | |
| | Residue | Oils |
| Non-Catalytic | 61.5 | 39.5* |
| Catalytic | 100.0 | 0.0* |

*Calculated by Difference

The product distribution obtained from the overall process of the solvent extraction an hydroliquefaction without a preliminary vacuum distillation, but in both a non-catalytic and catalytic liquefaction mode is shown in Table 7. The oil yield in the table is the sum of extraction and liquefaction. The oil yield is higher than the yield shown in Table 2.

TABLE 7

| Overall Product Distribution (wt % Full Range Bitumen) | | | |
|---|---|---|---|
| | Hydroliquefaction Reaction | | |
| | | Mo-Octoate | |
| | No-Catalyst | 500 ppm | 1000 ppm |
| Gases | 0.88 | 1.08 | 1.0 |
| Oil | 93.28 | 94.05 | 94.34 |
| Unconverted Material | 5.84 | 4.93 | 4.66 |
| Overall Conversion | 94.16 | 95.07 | 95.34 |

Higher overall oil yield obtained in the process involving solvent extraction followed by hydroliquefaction (FIG. 2) than that obtained in the distillation process (FIG. 1) clearly shows the improvement of solvent extraction over elevated temperature process steps, such as distillation, which causes polymerization of middle to high boiling range hydrocarbons depending on the temperature level. The solvent extraction embodiment (FIG. 2) of the present invention provides slightly improved results over the distillation embodiment (FIG. 1) as set forth in Tables 8A and 8B below.

TABLE 8A

| Comparison of the Two Preferred Schemes (Uncatalyzed) | | |
|---|---|---|
| | Distillation/Solvent Extraction/Non-Catalytic Hydroliquefaction | Solvent Extraction/Non-Catalytic Hydroliquefaction |
| Gases | 0.8 | 0.88 |
| Oil | 89.4 | 93.28 |
| Unconverted Material | 9.8 | 5.84 |
| Overall | 90.2 | 94.16 |

TABLE 8A-continued

| Comparison of the Two Preferred Schemes (Uncatalyzed) | | |
|---|---|---|
| | Distillation/Solvent Extraction/Non-Catalytic Hydroliquefaction | Solvent Extraction/Non-Catalytic Hydroliquefaction |
| Conversion | | |

TABLE 8B

| Comparison of the Two Preferred Schemes (Catalyzed) | | |
|---|---|---|
| | Distillation/Solvent Extraction/Catalytic Hydroliquefaction | Solvent Extraction/Catalytic Hydroliquefaction |
| Gases | 0.9 | 1.0 |
| Oil | 92.5 | 94.34 |
| Unconverted Material | 6.6 | 4.66 |
| Overall Conversion | 93.4 | 95.34 |

The comparison data given in Table 9 below wherein the conversion of the present process for the production of oils is compared to the processes of U.S. Pat. Nos. 4,111,787, 4,125,455 and 4,294,686, respectively shows the significant oil production and total conversion of the invention with respect to the prior art.

TABLE 9

| | | Gas Make | Total Conversion | Oil | Residue |
|---|---|---|---|---|---|
| U.S. Pat. No. 4,111,787 Exxon | | 6.5 | 88.5% | 82% | 11.5% |
| U.S. Pat. No. 4,125,455 Texaco | | 12% | 81% | 65% | 19% |
| U.S. Pat. No. 4,294,686 Gulf | | 4.6% | 81.9% | 77.3% | 18.1% |
| Present Invention | (FIG. 1) no cat. | 0.8% | 90.2% | 89.4% | 9.8% |
| | (FIG. 1) cat. | 0.9% | 93.4% | 92.5% | 6.6% |
| | (FIG. 2) no cat. | 0.88% | 94.16% | 93.28% | 5.84% |
| | (FIG. 2) cat. | 1% | 95.34% | 94.34% | 4.66% |

As is apparent from a review of the comparison data in the preceding table, the present invention, both in its non-catalytic and its catalytic form, provides an approximately 10% increase in the oil production over the closest prior art. However, this improvement alone is not the only unexpected result of the present invention in comparison to the practices of the prior art. The extremely low gas make, which gas constitutes an undesired by-product in such processes and which results in more hydrogen consumption for more gas make, is also significant in comparison to the results of the prior art as shown in the above tables. The present invention has a gas make approximately in the 1% range based on feedstock. The other processes range from 12 down to 4.6% gas make. It is believed the gas make of the present invention is a significant reduction over that of the prior art. Finally, it is noteworthy to compare the residue of the various processes of the prior art in comparison to the present invention. The present invention produces less than 10% residue based upon the feedstock material. This residue is an undesired by-product which usually constitutes pitch. It has a sizeably less marketable value and is useful only as a hydrogen source or plant fuel. The closest prior art patents indicate a residue in the range of approximately 11% to 19%. This residue which constitutes an undesired by-product is significantly reduced by the process of the present invention.

The present invention has also been found to effect a significant reduction in nitrogen, sulfur and metal contamination in the resulting distillable oil fraction. Such a reduction is beneficial to the downstream traditional refining of the distillable oil product.

The present invention has been set forth by illustration with several specific preferred embodiments. However, the invention should not be deemed to be limited to these specific embodiments, but rather the scope of the present invention should be ascertained by the claims which follow.

We claim:

1. A process for the hydrogen donor solvent hydroliquefaction of a heavy hydrocarbon oil or residuum having an API gravity at 60° F. of less than 20° comprising the steps of:

(a) contacting said heavy hydrocarbon oil or residuum with an extracting solvent to remove lighter hydrocarbon components which constitute solvent soluble components of the oil or residuum (b) mixing the solvent extracted residue oil or residuum with a hydrogen donor solvent having a boiling point of at least 375° F. to produce a liquefaction feedstock;

(c) hydroliquefying said feedstock in the presence of a hydrogen atmosphere at a pressure of at least 500 psia and a temperature of at least 650° F.;

(d) separating the hydroliquefied product of step (c) from any gas phase which exists in the product;

(e) separating said hydroliquefied product into a distillable oil fraction and a non-distillable bottom fraction, and (f) recycling a portion of the distillable oil fraction to step (b) as at least a portion of the hydrogen donor solvent.

2. The process of claim 1, step (b) wherein an unsupported disposable hydrogenation catalyst is mixed with the hydrogen donor solvent and the oil or residuum to produce a liquefaction feedstock and then catalytically hydroliquefying the same.

3. The process of claim 1 wherein the heavy oil or residuum is first subjected to a mild vacuum distillation below a temperature of 850° F. corrected to 760 mm Hg before performing step (a) in order to remove highly volatile portions of the lighter hydrocarbon components of the oil or residuum prior to severe hydroliquefaction conditions.

4. The process of claim 2 wherein the heavy oil or residuum is first subjected to a mild vacuum distillation below a temperature of 850° F. corrected to 760 mm Hg before performing step (a) in order to remove highly volatile portions of the lighter hydrocarbon components of the oil or residuum prior to severe hydroliquefaction conditions.

5. The process of claim 1 wherein at least a portion of the non-distillable bottom fraction of step (e) is recycled to the mixing stage of step (b) for further hydroliquefaction.

6. The process of claim 2 wherein the hydrogenation catalyst is added in an amount of between 10 and 10,000 ppm by weight based upon the elemental metal contained in the catalyst and the initial feed hydrocarbon oil.

7. The process of claim 6 wherein the catalyst is chosen from a metal compound of Groups IVBW, VB, VIB, VIIB or VIII.

8. The process of claim 1 wherein the residue oil or residuum of step (b) comprises between 35 and 75% by weight of the hydroliquefaction slurry.

9. The process of claim 1 wherein the hydrogen donor solvent is selected from the group comprising anthracene oil, creosote oil, coal derived oil, petroleum derived oil, distillate material derived from the process or mixtures of these solvents.

10. The process of claim 1 wherein the hydroliquefaction is conducted at a pressure in the range of 500 to 5000 psig.

11. The process of claim 10 wherein the hydroliquefaction reaction is conducted at a temperature in the range of 650° to 900° F.

12. The process of claim 2 wherein at least a portion of the non-distillable bottom fraction of step (e) is recycled to the mixing step (b).

13. The process of claim 1 in which at least a portion of the hydrogen atmosphere of step (c) is provided by recovery of hydrogen from the gas phase of step (d) and recycling it.

14. The process of claim 1 wherein the heavy hydrocarbon oil is a tar sand bitumen.

15. The process of claim 2 wherein the heavy hydrocarbon oil is a tar sand bitumen.

16. The process of claim 1 wherein the separation of step (e) is a distillation.

17. The process of claim 2 wherein the separation of step (e) is a distillation.

18. The process of claim 2 in which at least a portion of the hydrogen atmosphere of step (c) is provided by recovery of hydrogen from the gas phase of step (d) and recycling it.

* * * * *

UNITED STATES PATENT AND TRADEMARK OFFICE

CERTIFICATE OF CORRECTION

PATENT NO. : 4,465,587

DATED : August 14, 1984

INVENTOR(S) : Diwakar Garg and Robert N. Miller

It is certified that error appears in the above-identified patent and that said Letters Patent are hereby corrected as shown below:

Column 18, Line 15
Delete "IVBW" and substitute therefor -- IVB

Signed and Sealed this

*Fifth* Day of *March 1985*

[SEAL]

*Attest:*

DONALD J. QUIGG

*Attesting Officer* *Acting Commissioner of Patents and Trademarks*